US009869306B2

(12) United States Patent
Yang et al.

(10) Patent No.: US 9,869,306 B2
(45) Date of Patent: Jan. 16, 2018

(54) MULTISTAGE AIR PUMP

(71) Applicants: Chui-Ching Yang, New Taipei (TW); Hsin-Yi Yang, New Taipei (TW)

(72) Inventors: Chui-Ching Yang, New Taipei (TW); Hsin-Yi Yang, New Taipei (TW)

( * ) Notice: Subject to any disclaimer, the term of this patent is extended or adjusted under 35 U.S.C. 154(b) by 432 days.

(21) Appl. No.: 14/451,850

(22) Filed: Aug. 5, 2014

(65) Prior Publication Data

US 2015/0337821 A1 Nov. 26, 2015

(30) Foreign Application Priority Data

May 21, 2014 (TW) ..... 103117784 A

(51) Int. Cl.

| | |
|---|---|
| ***F04B 9/14*** | (2006.01) |
| ***F04B 25/04*** | (2006.01) |
| ***F04B 39/12*** | (2006.01) |
| ***F04B 39/10*** | (2006.01) |
| ***F04B 53/14*** | (2006.01) |
| ***F04B 53/12*** | (2006.01) |
| ***F04B 33/00*** | (2006.01) |

(52) U.S. Cl.

CPC ..... *F04B 25/04* (2013.01); *F04B 9/14* (2013.01); *F04B 33/005* (2013.01); *F04B 39/1006* (2013.01); *F04B 39/121* (2013.01); *F04B 53/126* (2013.01); *F04B 53/144* (2013.01)

(58) Field of Classification Search

CPC .... F04B 3/00; F04B 3/003; F04B 9/14; F04B 25/04; F04B 33/005; F04B 39/0016; F04B 39/121; F04B 53/126; F04B 53/144

USPC ..... 417/244, 259, 266, 267

See application file for complete search history.

(56) References Cited

U.S. PATENT DOCUMENTS

| | | | | |
|---|---|---|---|---|
| 817,538 A * | 4/1906 | Wixon | ..... | F04B 3/003 417/258 |
| 2,443,344 A * | 6/1948 | Ekleberry | ..... | F04B 25/02 417/261 |
| 6,065,947 A * | 5/2000 | Wu | ..... | F04B 25/02 417/526 |

* cited by examiner

*Primary Examiner* — Philip Stimpert
(74) *Attorney, Agent, or Firm* — Bacon & Thomas, PLLC

(57) ABSTRACT

A multistage air pump has a cylinder assembly, a second piston assembly slidably mounted through the cylinder assembly, and a first piston assembly protruding in the second piston assembly. Multiple chambers are defined in the multistage air pump, and communicate with each other via multiple one-way mechanisms. Air drawn into the multistage air pump is compressed in multiple stages within a single push, such that a large amount of high pressure air is provided.

3 Claims, 16 Drawing Sheets

MULTISTAGE AIR PUMP

BACKGROUND OF THE INVENTION

1. Field of the Invention

The present invention relates to a multistage air pump, especially to an air pump that can pressurize air inside the air pump in multiple stages within a single push by a piston.

2. Description of the Prior Art(s)

Air pumps are common tools used in daily life. The air pumps are used for inflating articles such as balls or tires, especially the tires of mountain bicycles.

With reference to FIG. 15, a first conventional air pump comprises a cylinder 12, a piston assembly 11, and an exhaust seat 13. The cylinder 12 is tubular and has a front cap 121 and a rear cap 122 respectively mounted on two opposite ends of the cylinder 12. An inlet one-way valve is mounted in the front cap 121 of the cylinder 12 and only allows air to flow into the cylinder 12. The rear cap 122 has a through hole 123. The piston assembly 11 has a piston rod 111, a handle 112, a piston 113, and a sealing ring 114. The piston rod 111 is mounted through the rear cap 122 and axially protrudes in the cylinder 12. The handle 112 is mounted on an outer end of the piston rod 111. The piston 113 is mounted on an inner end of the piston rod 111. The sealing ring 114 is mounted around the piston 113. The piston 113 and the sealing ring 114 are disposed inside the cylinder 12 and are driven to move forward and backward alternately by the piston rod 111. A front chamber is defined in the cylinder 12 and between the piston 113 and the front cap 121. A rear chamber is defined in the cylinder 12 and between the piston 113 and the rear cap 122. The exhaust seat 13 is mounted in the front cap 121 of the cylinder 12.

During operation, the exhaust seat 13 is connected to an inflatable article. A user holds the handle and alternately pushes and pulls the piston assembly 11 to drive the piston 113 and the sealing ring 114 to move forward and backward alternately. When the piston assembly 11 is pulled backwardly, air outside the cylinder 12 is drawn into the front chamber of the cylinder 12 via the inlet one-way valve, and air inside the rear chamber of the cylinder 12 is pushed to flow out of the rear chamber via the through hole 123 of the rear cap 122. When the piston assembly 11 is pushed forwardly, the air inside the front chamber of the cylinder 12 is pressurized and then flows out of the front chamber via the exhaust seat 13 to inflate the inflatable article. However, although the first conventional air pump has a simple structure and is easy for operation, the first conventional air pump can only provide low pressure air. Thus, the first conventional air pump can only be used for inflating articles that need low pressure air, such as balls. The first conventional air pump cannot be used for inflating articles that need high pressure air, such as tires of bicycles.

With further reference to FIG. 16, in order to inflate the tires of the bicycles, especially the tires of the mountain bicycles, a second conventional air pump is designed. The conventional air pump comprises a cylinder 22, a piston assembly 21, and an exhaust seat 23. The cylinder 22 has a front cap 221 and a rear cap 222 respectively mounted on two opposite ends of the cylinder 22. An inlet one-way valve is mounted in the front cap 221 of the cylinder 22. The rear cap 222 has a through hole. The piston assembly 21 has a piston rod 211, a handle 212, a piston 213, and a sealing ring 214. The piston rod 211 is mounted through the rear cap 222. The handle 212 is mounted on an outer end of the piston rod 211. The piston 213 is mounted on an inner end of the piston rod 211. The sealing ring 214 is mounted around the piston 213. The piston 213 and the sealing ring 214 are driven to move forward and backward alternately by the piston rod 211. The exhaust seat 23 is mounted in the front cap 221 of the cylinder 22.

Compared with the first conventional air pump, a volume of the cylinder 22 and a cross-sectional area of the piston 213 of the second air pump are reduced. Accordingly, an inner diameter of the cylinder 22 of the second conventional air pump is shorter than an inner diameter of the cylinder 12 of the first conventional air pump. The second conventional air pump has higher compression ratio than the first conventional air pump, and can provide high pressure air to inflate the tires of the bicycles. However, since the volume of the cylinder 22 of the second conventional air pump is reduced, each time when the user pushes the piston rod 211, only a small amount of the high pressure air is formed. Therefore, for inflating the same article, times of pushing and pulling the piston assembly 21 of the second conventional air pump are more than times of pushing and pulling the piston assembly 11 of the first conventional air pump. Inflating the article with the second conventional air pump takes extra labor work and increases operation time, which leads to low efficiency.

To overcome the shortcomings, the present invention provides a multistage air pump to mitigate or obviate the aforementioned problems.

SUMMARY OF THE INVENTION

The main objective of the present invention is to provide a multistage air pump. The multistage air pump has a cylinder assembly, a surrounding piston assembly slidably mounted through the cylinder assembly, and an inner piston assembly mounted on the cylinder assembly and protruding in the surrounding piston assembly. Multiple chambers are defined in the multistage air pump, communicate with exterior of the multistage air pump via at least one inlet one-way mechanism and at least one outlet one-way mechanism, and communicate with each other via multiple one-way mechanisms.

During operation, air that is drawn into the multistage air pump is compressed and pressurized in multiple stages within a single push by the piston assemblies. Thus, the multistage air pump can provide a large amount of high pressure air, such that inflating the article with the multistage air pump is labor-saving and efficient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
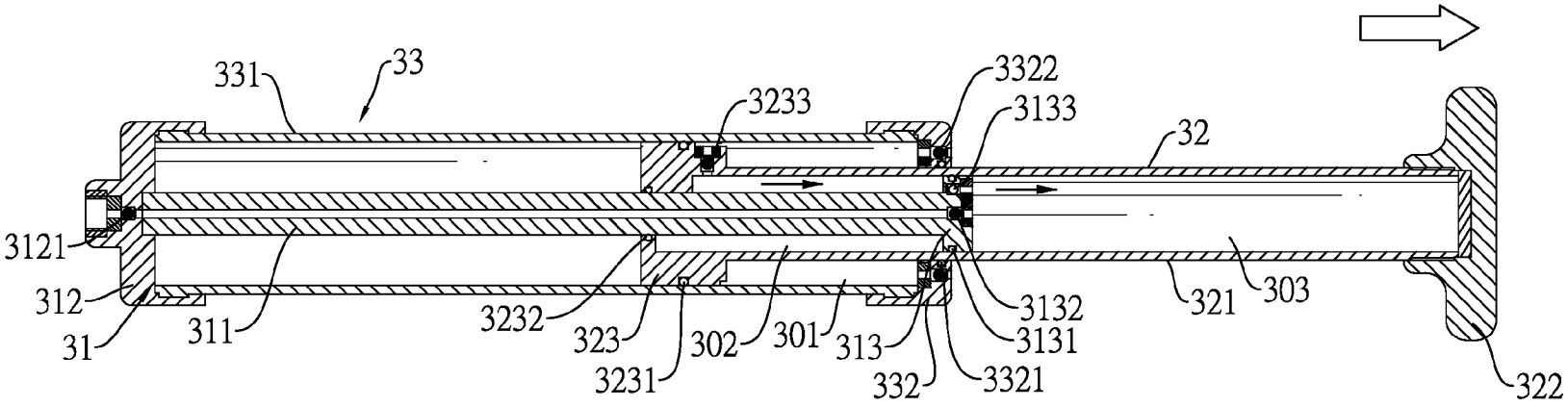
FIG. 1 is an operational side view in partial section of a first embodiment of a multistage air pump in accordance with the present invention.

With reference to FIGS. 1, 3, 5, 7, 9, 11, and 13, a multistage air pump in accordance with the present invention comprises a cylinder assembly 33, 43, 53, 63, 73, 83, 93, a surrounding piston assembly 32, 42, 52, 62, 72, 82, 92, an inner piston assembly 31, 41, 51, 61, 71, 81, 91, a second chamber 302, 402, 502, 602, 702, 802, 902, and a third chamber 303, 403, 503, 603, 703, 803, 903.

The cylinder assembly 33, 43, 53, 63, 73, 83, 93 has a cylinder 331, 431, 531, 631, 731, 831, 931 and a rear cap 332, 432, 532, 632, 732, 832, 932. The cylinder 331, 431, 531, 631, 731, 831, 931 is tubular and has a front end and a rear end. The rear cap 332, 432, 532, 632, 732, 832, 932 is mounted on the rear end of the cylinder 331, 431, 531, 631, 731, 831, 931 and has a through hole formed through the rear cap 332, 432, 532, 632, 732, 832, 932.

The surrounding piston assembly 32, 42, 52, 62, 72, 82, 92 is slidably mounted through the through hole of the rear cap 332, 432, 532, 632, 732, 832, 932 and has a surrounding rod 321, 421, 521, 621, 721, 821, 921, a surrounding piston 323, 423, 523, 623, 723, 823, 923, a second end cap 322, 422, 522, 622, 722, 822, 922, an inner sealing ring 3232, 6232, and at least one one-way mechanism 3233, 4233, 5233, 5234, 6233, 7233, 8233, 8234, 9233, 9234.

The surrounding rod 321, 421, 521, 621, 721, 821, 921 is slidably mounted through the through hole of the rear cap 332, 432, 532, 632, 732, 832, 932 and has an inner end, an outer end, and a sliding channel. The inner end of the surrounding rod 321, 421, 521, 621, 721, 821, 921 protrudes in the cylinder 331, 431, 531, 631, 731, 831, 931. The outer end of the surrounding rod 321, 421, 521, 621, 721, 821, 921 protrudes out of the cylinder 331, 431, 531, 631, 731, 831, 931. The sliding channel of the surrounding rod 321, 421, 521, 621, 721, 821, 921 is axially formed between the inner end of the surrounding rod 321, 421, 521, 621, 721, 821, 921 and the outer end of the surrounding rod 321, 421, 521, 621, 721, 821, 921.

The surrounding piston 323, 423, 523, 623, 723, 823, 923 is formed on the inner end of the surrounding rod 321, 421, 521, 621, 721, 821, 921, is mounted in the cylinder 331, 431, 531, 631, 731, 831, 931, and has a through hole and an inner sidewall. The through hole of the surrounding piston 323, 423, 523, 623, 723, 823, 923 is axially formed through the surrounding piston 323, 423, 523, 623, 723, 823, 923 and communicates with the sliding channel of the surrounding rod 321, 421, 521, 621, 721, 821, 921. The inner sidewall of the surrounding piston 323, 423, 523, 623, 723, 823, 923 is formed around the through hole of the surrounding piston 323, 423, 523, 623, 723, 823, 923.

The second end cap 322, 422, 522, 622, 722, 822, 922 is mounted on the outer end of the surrounding rod 321, 421, 521, 621, 721, 821, 921. The inner sealing ring 3232, 6232 is mounted on and around the inner sidewall of the surrounding piston 323, 423, 523, 623, 723, 823, 923. The at least one one-way mechanism 3233, 4233, 5233, 5234, 6233, 7233, 8233, 8234 of the surrounding piston assembly 32, 42, 52, 62, 72, 82, 92 is mounted in the surrounding piston 323, 423, 523, 623, 723, 823, 923.

The inner piston assembly 31, 41, 51, 61, 71, 81, 91 is mounted on the cylinder 331, 431, 531, 631, 731, 831, 931 and has an inner rod 311, 411, 511, 611, 711, 811, 911, an inner piston 313, 413, 513, 613, 713, 813, 913, a first end cap 312, 412, 512, 612, 712, 812, 912, and at least one one-way mechanism 3133, 4133, 5133, 6133, 7133, 8133, 9133.

The inner rod 311, 411, 511, 611, 711, 811, 911 is axially mounted in the cylinder 331, 431, 531, 631, 731, 831, 931, is mounted through the through hole of the surrounding piston 323, 423, 523, 623, 723, 823, 923, abuts the inner sealing ring 3232, 6232 of the surrounding piston assembly 32, 42, 52, 62, 72, 82, 92, and has an inner end and an outer end. The inner end of the inner rod 311, 411, 511, 611, 711, 811, 911 protrudes in the sliding channel of the surrounding rod 321, 421, 521, 621, 721, 821, 921. The outer end of the inner rod 311, 411, 511, 611, 711, 811, 911 is opposite to the inner end of the inner rod 311, 411, 511, 611, 711, 811, 911 and corresponds in position to the front end of the cylinder 331, 431, 531, 631, 731, 831, 931.

The inner piston 313, 413, 513, 613, 713, 813, 913 is formed on the inner end of the inner rod 311, 411, 511, 611, 711, 811, 911 and is mounted in the sliding channel of the surrounding rod 321, 421, 521, 621, 721, 821, 921. The first end cap 312, 412, 512, 612, 712, 812, 912 is mounted on the front end of the cylinder 331, 431, 531, 631, 731, 831, 931 and is connected to the outer end of the inner rod 311, 411, 511, 611, 711, 811, 911. The at least one one-way mechanism 3133, 4133, 5133, 6133, 7133, 8133, 9133 of the inner piston assembly 31, 41, 51, 61, 71, 81, 91 is mounted in the inner piston 313, 413, 513, 613, 713, 813, 913.

The second chamber 302, 402, 502, 602, 702, 802, 902 is defined in the sliding channel of the surrounding rod 321, 421, 521, 621, 721, 821, 921 and between the surrounding piston 323, 423, 523, 623, 723, 823, 923 and the inner piston 313, 413, 513, 613, 713, 813, 913. The at least one one-way mechanism 3233, 4233, 5233, 5234, 6233, 7233, 8233, 8234, 9233, 9234 of the surrounding piston assembly 32, 42, 52, 62, 72, 82, 92 only allows air inside an interior of the cylinder 331, 431, 531, 631, 731, 831, 931 to flow into the second chamber 302, 402, 502, 602, 702, 802, 902.

The third chamber 303, 403, 503, 603, 703, 803, 903 is defined in the sliding channel of the surrounding rod 321, 421, 521, 621, 721, 821, 921 and between the surrounding piston 323, 423, 523, 623, 723, 823, 923 and the second end cap 322, 422, 522, 622, 722, 822, 922, and selectively communicates with the second chamber 302, 402, 502, 602, 702, 802, 902 via the at least one one-way mechanism 3133, 4133, 5133, 6133, 7133, 8133, 9133 of the inner piston assembly 31, 41, 51, 61, 71, 81, 91. The at least one one-way mechanism 3133, 4133, 5133, 6133, 7133, 8133, 9133 of the inner piston assembly 31, 41, 51, 61, 71, 81, 91 only allows air inside the second chamber 302, 402, 502, 602, 702, 802, 902 to flow into the third chamber 303, 403, 503, 603, 703, 803, 903.

One of the piston assemblies 31, 41, 51, 62, 72, 82, 92 further has at least one outlet one-way mechanism 3121, 3132, 4121, 4132, 5121, 5132, 6221, 7221, 8221, 9221. One of the at least one outlet one-way mechanism 3121, 4121, 5121, 5221, 7221, 8221, 9221 is mounted in the end cap 312, 412, 512, 622, 722, 822 of the piston assembly 31, 41, 51, 62, 72, 82, 92. The third chamber 303, 403, 503, 603, 703, 803, 903 selectively communicates with an exterior of the multistage air pump via the at least one outlet one-way mechanism 3121, 3132, 4121, 4132, 5121, 5132, 6221, 7221, 8221, 9221. The at least one outlet one-way mechanism 3121, 3132, 4121, 4132, 5121, 5132, 6221, 7221, 8221, 9221 only allows air inside the third chamber 303, 403, 503, 603, 703, 803, 903 to flow to the exterior of the multistage air pump.

As shown in FIG. 1, in a first preferred embodiment, the surrounding piston 323 has an outer sidewall and a proximal end. The proximal end of the surrounding piston 323 is attached to the surrounding rod 321. The surrounding piston assembly 32 further has an outer sealing ring 3231. The outer sealing ring 3231 of the surrounding piston assembly 32 is mounted on and around the outer sidewall of the surrounding piston 323 and abuts the cylinder 331. The at least one one-way mechanism 3233 of the surrounding piston assembly 32 is disposed between the proximal end of the surrounding piston 323 and the outer sealing ring 3231 of the surrounding piston assembly 32.

The multistage air pump has a first chamber 301 defined in the cylinder 331 and between the rear cap 332 and the surrounding piston 323. The at least one one-way mechanism 3233 of the surrounding piston assembly 32 only allows air inside the first chamber 301 to flow into the second chamber 302.

The inner piston 313 has an outer sidewall. The inner piston assembly 31 has two outlet one-way mechanisms 3121, 3132, and a sealing ring 3131. The outlet one-way mechanisms 3121, 3132 are respectively mounted in the first end cap 312 and the inner piston 313. The sealing ring 3131 of the inner piston assembly 31 is mounted on and around the outer sidewall of the inner piston 313 and abuts the surrounding rod 321. The inner rod 311 has an air channel. The air channel of the inner rod 311 is axially formed in the inner rod 311 and between the outer end of the inner rod 311 and the inner end of the inner rod 311. The air channel of the inner rod 311 communicates with the third chamber 303 via the outlet one-way mechanism 3132 that is mounted in the inner piston 313, and communicates with the exterior of the multistage air pump via the outlet one-way mechanism 3121 that is mounted in the first end cap 312.

The rear cap 332 has an inner sidewall formed around the through hole of the rear cap 332. The cylinder assembly 33 further has a sealing ring 3321 and at least one inlet one-way mechanism 3322. The sealing ring 3321 of the cylinder assembly 33 is mounted on and around the inner sidewall of the rear cap 332 and abuts the surrounding rod 321. The at least one inlet one-way mechanism 3322 is mounted in the rear cap 332, is disposed around the through hole of the rear cap 332, and only allows air outside the multistage air pump to flow into the first chamber 301.

As shown in FIG. 1, during operation, the first end cap 312 is connected to an inflatable article. A user holds the cylinder assembly 33 and alternately pushes and pulls the surrounding piston assembly 32 to drive the surrounding rod 321 and the surrounding piston 323 to move forward and backward alternately. When the surrounding piston assembly 32 is pulled, volumes of the first chamber 301 and the second chamber 302 are decreased, and volume of the third chamber 303 is increased. Accordingly, air inside the first chamber 301 and the second chamber 302 is compressed, and air inside the third chamber 303 is decompressed. Thus, the air inside the second chamber 302 flows into the third chamber 303 via the at least one one-way mechanism 3133 of the inner piston assembly 31. Even though air pressure inside the first chamber 301 is higher than air pressure outside the multistage air pump, the air inside the first chamber 301 cannot flow out of the first chamber 301 via the at least one inlet one-way mechanism 3322. The air inside the first chamber 301 does not flow to the second chamber 302 via the at least one one-way mechanism 3233 of the surrounding piston assembly 32 until the air pressure inside the first chamber 301 becomes higher than air pressure inside the second chamber 302.

Figure 2:
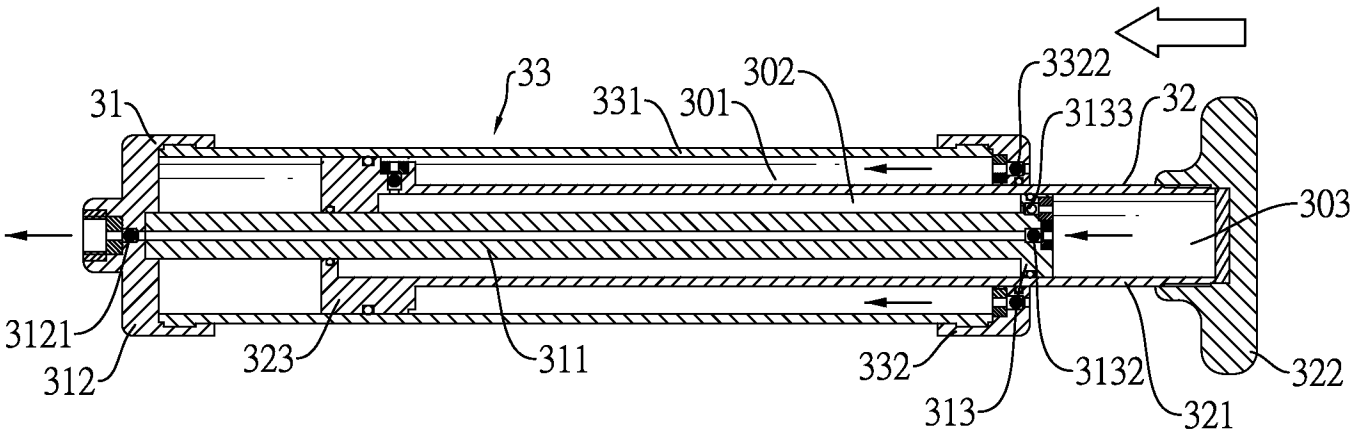
FIG. 2 is another operational side view in partial section of the multistage air pump in FIG. 1.

With further reference to FIG. 2, when the surrounding piston assembly 32 is pushed, the volumes of the first chamber 301 and the second chamber 302 are increased, and the volume of the third chamber 303 is decreased. Accordingly, the air inside the third chamber 303 is compressed, and the air inside the first chamber 301 and the second chamber 302 is decompressed. Thus, the air outside the multistage air pump flows into the first chamber 301 via the at least one inlet one-way mechanism 3322 of the cylinder assembly 33. Since air pressure inside the third chamber 303 is higher than the air pressure inside the second chamber 302, the air inside the second chamber 302 cannot flow to the third chamber 303 via the at least one one-way mechanism 3133 of the inner piston assembly 31. The compressed air inside the third chamber 303 flows into the inflatable article via the outlet one-way mechanism 3132 that is mounted in the inner piston 313, the air channel of the inner rod 311, and the outlet one-way mechanism 3121 that is mounted in the first end cap 312.

Figure 3:
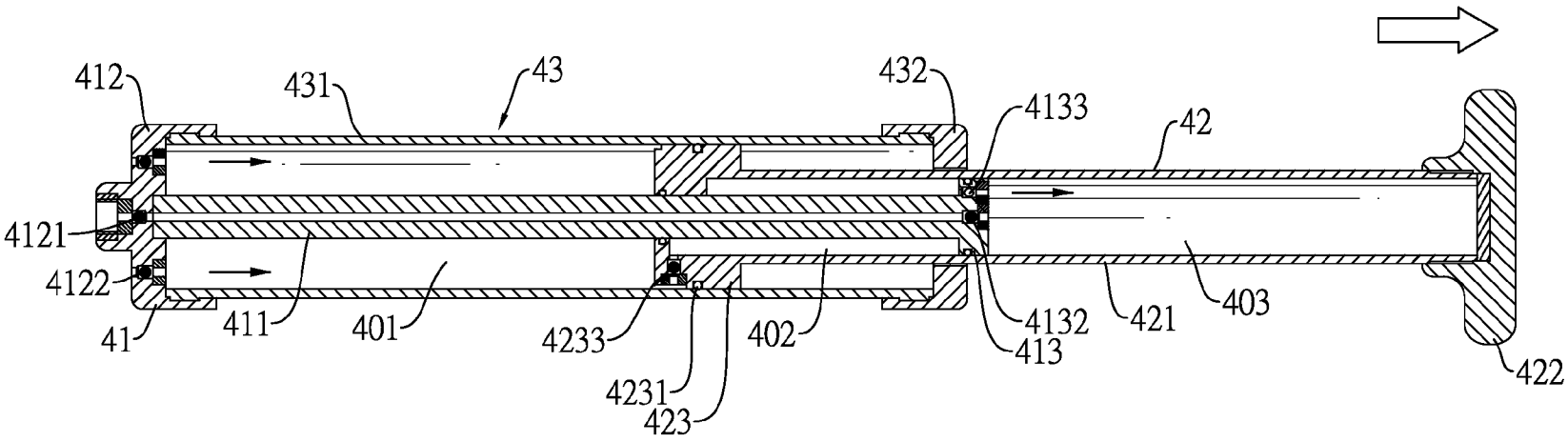
FIG. 3 is an operational side view in partial section of a second embodiment of a multistage air pump in accordance with the present invention.

As shown in FIG. 3, in a second preferred embodiment, the surrounding piston 423 has an outer sidewall and a distal end. The surrounding piston assembly 42 further has an outer sealing ring 4231. The outer sealing ring 4231 of the surrounding piston assembly 42 is mounted on and around the outer sidewall of the surrounding piston 423 and abuts the cylinder 431. The at least one one-way mechanism 4233 of the surrounding piston assembly 42 is disposed between the distal end of the surrounding piston 423 and the outer sealing ring 4231 of the surrounding piston assembly 42.

The multistage air pump has a first chamber 401 defined in the cylinder 431 and between the first end cap 412 and the surrounding piston 423. The at least one one-way mechanism 4233 of the surrounding piston assembly 42 only allows air inside the first chamber 401 to flow into the second chamber 402.

The inner piston assembly 41 has two outlet one-way mechanisms 4121, 4132. The outlet one-way mechanisms 4121, 4132 are respectively mounted in the first end cap 412 and the inner piston 413. The inner rod 411 has an air channel. The air channel of the inner rod 411 is axially formed in the inner rod 411 and between the outer end of the inner rod 411 and the inner end of the inner rod 411. The air channel of the inner rod 411 communicates with the third chamber 403 via the outlet one-way mechanism 4132 that is mounted in the inner piston 413, and communicates with the exterior of the multistage air pump via the outlet one-way mechanism 4121 that is mounted in the inner end cap 412.

The inner piston assembly 41 further has at least one inlet one-way mechanism 4122. The at least one inlet one-way mechanism 4122 is mounted in the first end cap 412, and is disposed around the outlet one-way mechanism 4121 that is mounted in the first end cap 412. The at least one inlet one-way mechanism 4122 only allows air outside the multistage air pump to flow into the first chamber 401.

As shown in FIG. 3, during operation, the first end cap 412 is connected to the inflatable article. The user holds the cylinder assembly 43 and alternately pushes and pulls the surrounding piston assembly 42 to drive the surrounding rod 421 and the surrounding piston 423 to move forward and backward alternately. When the surrounding piston assembly 42 is pulled, volume of the second chamber 402 is decreased, and volumes of the first chamber 401 and the third chamber 403 are increased. Accordingly, air inside the second chamber 402 is compressed, and air inside the first chamber 401 and the third chamber 403 is decompressed. Thus, the air outside the multistage air pump flows into the first chamber 401 via the at least one inlet one-way mechanism 4122 of the inner piston assembly 41. Even though air pressure inside the second chamber 402 is higher than air pressure inside the first chamber 401, the compressed air inside the second chamber 402 cannot flow to the first chamber 401 via the at least one one-way mechanism 4233 of the surrounding piston assembly 42. The compressed air inside the second chamber 402 flows into the third chamber 403 via the at least one one-way mechanism 4133 of the inner piston assembly 41.

Figure 4:
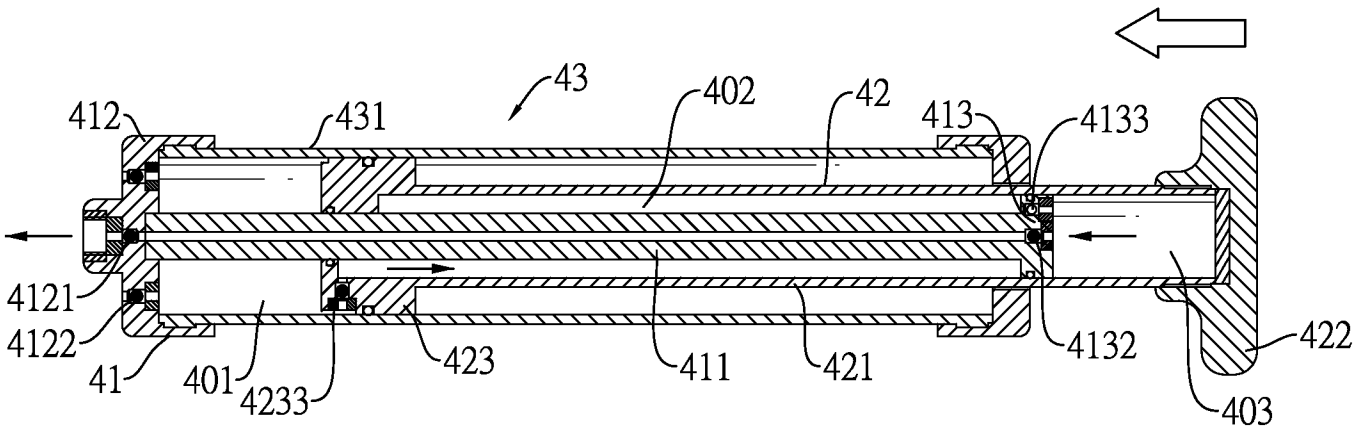
FIG. 4 is another operational side view in partial section of the multistage air pump in FIG. 3.

With further reference to FIG. 4, when the surrounding piston assembly 42 is pushed, the volume of the second chamber 402 is increased, and the volumes of the first chamber 401 and the third chamber 403 are decreased. Accordingly, the air inside the first chamber 401 and the third chamber 403 is compressed, and the air inside the second chamber 402 is decompressed. Thus, since the compressed air inside the first chamber 301 cannot flow out of the first chamber 301 via the at least one inlet one-way mechanism 4122, the compressed air inside the first chamber 401 flows into the second chamber 402 via the at least one one-way mechanism 4233 of the surrounding piston assembly 42. Moreover, even though air pressure inside the third chamber 403 is higher than the air pressure inside the second chamber 402, the air inside the third chamber 403 cannot flow to the second chamber 402 via the at least one one-way mechanism 4133 of the inner piston assembly 41. The compressed air inside the third chamber 403 flows into the inflatable article via the outlet one-way mechanism 4132 that is mounted in the inner piston 413, the air channel of the inner rod 411, and the outlet one-way mechanism 4121 that is mounted in the first end cap 412.

Figure 5:
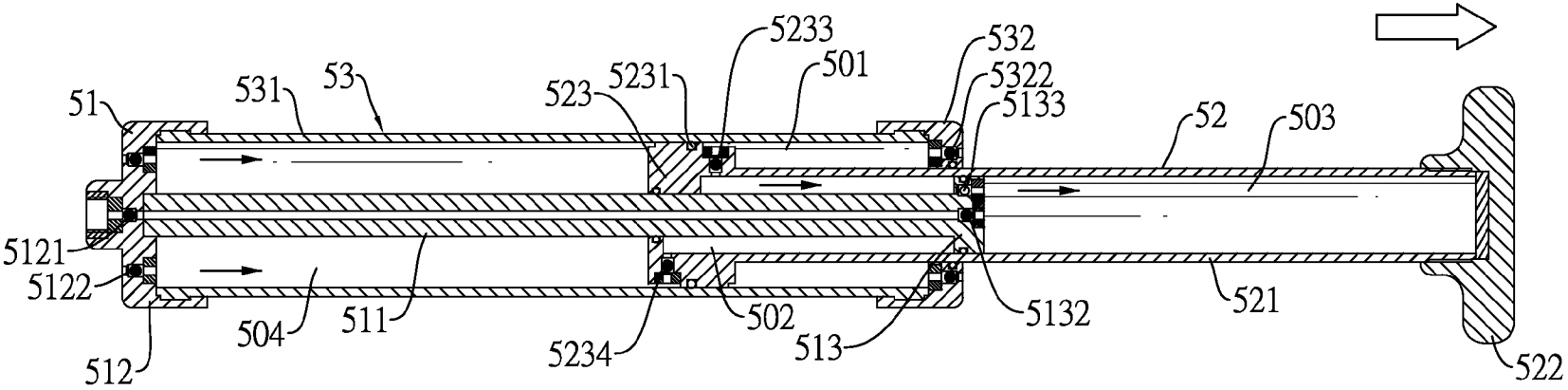
FIG. 5 is an operational side view in partial section of a third embodiment of a multistage air pump in accordance with the present invention.

As shown in FIG. 5, in a third preferred embodiment, the surrounding piston 523 has an outer sidewall, a distal end, and a proximal end. The proximal end of the surrounding piston 523 is attached to the surrounding rod 521. The surrounding piston assembly 52 further has an outer sealing ring 5231. The outer sealing ring 5231 of the surrounding piston assembly 52 is mounted on and around the outer sidewall of the surrounding piston 523 and abuts the cylinder 531. The surrounding piston assembly 52 has two one-way mechanisms 5233, 5234. The one-way mechanisms 5233, 5234 of the surrounding piston assembly 52 are respectively disposed between the proximal end of the surrounding piston 523 and the outer sealing ring 5231 of the surrounding piston assembly 52, and between the distal end of the surrounding piston 523 and the outer sealing ring 5231 of the surrounding piston assembly 52.

The multistage air pump has a first chamber 501 and a fourth chamber 504. The first chamber 501 is defined in the cylinder 531 and between the rear cap 532 and the surrounding piston 523. The fourth chamber 504 is defined in the cylinder 531 and between the first end cap 512 and the surrounding piston 523. The one-way mechanisms 5233, 5234 of the surrounding piston assembly 52 only allow air inside the first chamber 501 and the fourth chamber 504 to flow into the second chamber 502.

The inner piston assembly 51 has two outlet one-way mechanisms 5121, 5132. The outlet one-way mechanisms 5121, 5132 are respectively mounted in the first end cap 512 and the inner piston 513. The inner rod 511 has an air channel. The air channel of the inner rod 511 is axially formed in the inner rod 511 and between the outer end of the inner rod 511 and the inner end of the inner rod 511. The air channel of the inner rod 511 communicates with the third chamber 503 via the outlet one-way mechanism 5132 that is mounted in the inner piston 513, and communicates with the exterior of the multistage air pump via the outlet one-way mechanism 5121 that is mounted in the first end cap 512.

The cylinder assembly 53 further has at least one inlet one-way mechanism 5322. The at least one inlet one-way mechanism 5322 of the cylinder assembly 53 is mounted in the rear cap 532, is disposed around the through hole of the rear cap 532, and only allows air outside the multistage air pump to flow into the first chamber 501.

The inner piston assembly 51 further has at least one inlet one-way mechanism 5122. The at least one inlet one-way mechanism 5122 of the inner piston assembly 51 is mounted in the first end cap 512, and is disposed around the outlet one-way mechanism 5121 that is mounted in the first end cap 512. The at least one inlet one-way mechanism 5122 of the inner piston assembly 51 only allows the air outside the multistage air pump to flow into the fourth chamber 504.

As shown in FIG. 5, during operation, the first end cap 512 is connected to the inflatable article. The user holds the cylinder assembly 53 and alternately pushes and pulls the surrounding piston assembly 52 to drive the surrounding rod 521 and the surrounding piston 523 to move forward and backward alternately. When the surrounding piston assembly 52 is pulled, volumes of the first chamber 501 and the second chamber 502 are decreased, and volumes of the third chamber 503 and the fourth chamber 504 are increased. Accordingly, air inside the first chamber 501 and the second chamber 502 is compressed, and air inside the third chamber 503 and the fourth chamber 504 is decompressed. Thus, the compressed air inside the second chamber 502 flows into the third chamber 503 via the at least one one-way mechanism 5133 of the inner piston assembly 51. The compressed air inside the second chamber 502 cannot flow to the first chamber 501 via the one-way mechanism 5233 that is disposed between the proximal end of the surrounding piston 523 and the outer sealing ring 5231 of the surrounding piston assembly 52. The air inside the first chamber 501 cannot flow out of the multistage air pump via the at least one inlet one-way mechanism 5322 of the cylinder assembly 53. As air pressure inside the first chamber 501 is higher than air pressure inside the second chamber 502, the compressed air inside the first chamber 501 flows into the second chamber 502 via the one-way mechanism 5233 that is disposed between the proximal end of the surrounding piston 523 and the outer sealing ring 5231 of the surrounding piston assembly 52. Moreover, the air outside the multistage air pump flows into the fourth chamber 504 via the at least one inlet one-way mechanism 5122 of the inner piston assembly 51. Even though air pressure inside the second chamber 502 is higher than air pressure inside the fourth chamber 504, the air inside the second chamber 502 cannot flow to the fourth chamber 504 via the one-way mechanism 5234 that is disposed between the distal end of the surrounding piston 523 and the outer sealing ring 5231 of the surrounding piston assembly 52.

Figure 6:
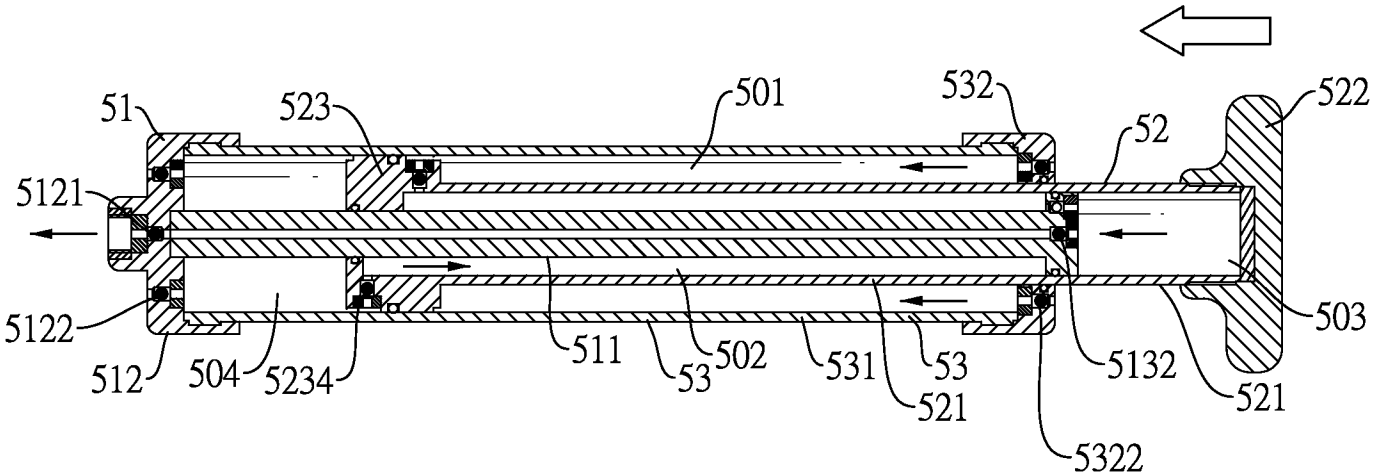
FIG. 6 is another operational side view in partial section of the multistage air pump in FIG. 5.

With further reference to FIG. 6, when the surrounding piston assembly 52 is pushed, the volumes of the first chamber 501 and the second chamber 502 are increased, and the volumes of the third chamber 503 and the fourth chamber 504 are decreased. Accordingly, the air inside the third chamber 503 and the fourth chamber 504 are compressed, and the air inside the first chamber 501 and the second chamber 502 are decompressed. Thus, the air outside the multistage air pump flows into the first chamber 501 via the at least one inlet one-way mechanism 5322 of the cylinder assembly 53. The compressed air inside the fourth chamber 504 flows into the second chamber 502 via the one-way mechanism 5234 that is disposed between the distal end of the surrounding piston 523 and the outer sealing ring 5231 of the surrounding piston assembly 52. The compressed air inside the fourth chamber 504 cannot flow out of the multistage air pump via the at least one inlet one-way mechanism 5122 of the inner piston assembly 51. Moreover, the compressed air inside the third chamber 503 flows into the inflatable article via the outlet one-way mechanism 5132 that is mounted in the inner piston 513, the air channel of the inner rod 511, and the outlet one-way mechanism 5121 that is mounted in the first end cap 512.

Figure 7:
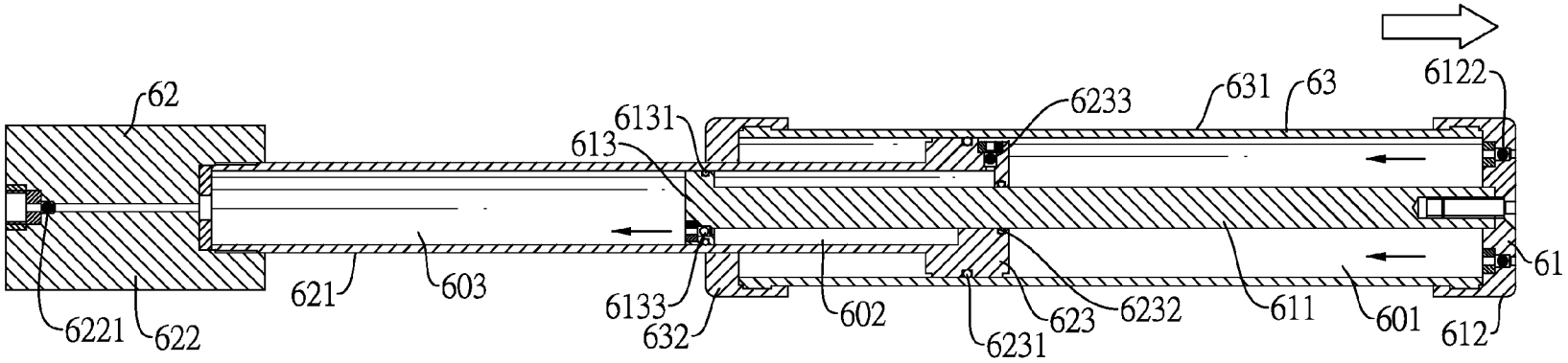
FIG. 7 is an operational side view in partial section of a fourth embodiment of a multistage air pump in accordance with the present invention.

As shown in FIG. 7, in a fourth preferred embodiment, the surrounding piston 623 has an outer sidewall and a distal end. The second end cap 622 has an air channel. The air channel of the second end cap 622 is axially formed through the second end cap 622 and communicates with the third chamber 603. The surrounding piston assembly 62 has an outer sealing ring 6231 and one outlet one-way mechanism 6221. The outer sealing ring 6231 of the surrounding piston assembly 62 is mounted on and around the outer sidewall of the surrounding piston 623 and abuts the cylinder 631. The outlet one-way mechanism 6221 is mounted in the air channel of the second end cap 622 and only allows air inside the third chamber 603 to flow to the exterior of the multistage air pump. The at least one one-way mechanism 6233 of the surrounding piston assembly 62 is disposed between the distal end of the surrounding piston 623 and the outer sealing ring 6231 of the surrounding piston assembly 62.

The multistage air pump has a first chamber 601 defined in the cylinder 631 and between the first end cap 612 and the surrounding piston 623. The at least one one-way mechanism 6233 of the surrounding piston assembly 62 only allows air inside the first chamber 601 to flow into the second chamber 602.

The inner piston 613 has an outer sidewall. The inner piston assembly 61 has at least one inlet one-way mechanism 6122 and a sealing ring 6131. The at least one inlet one-way mechanism 6122 is mounted in the first end cap 612 and only allows air outside the multistage air pump to flow into the first chamber 601. The sealing ring 6131 of the inner piston assembly 613 is mounted on and around the outer sidewall of the inner piston 613 and abuts the surrounding rod 621.

As shown in FIG. 7, during operation, the second end cap 622 is connected to the inflatable article. The user holds the cylinder assembly 63 and alternately pushes and pulls the cylinder assembly 63 and the inner piston assembly 61 to drive the inner rod 611 and the inner piston 613 to move forwardly and backwardly alternately.

When the inner piston assembly 61 is pulled, volume of the second chamber 602 is decreased, and volumes of the first chamber 601 and the third chamber 603 are increased. Accordingly, air inside the second chamber 602 is compressed, and air inside the first chamber 601 and the third chamber 603 is decompressed. Thus, the compressed air inside the second chamber 602 cannot flow to the first chamber 601 via the at least one one-way mechanism 6233 of the surrounding piston assembly 62. The compressed air inside the second chamber 602 flows into the third chamber 603 via the at least one one-way mechanism 6133 of the inner piston assembly 61. Air outside the multistage air pump flows into the first chamber 601 via the inlet one-way mechanism 6122 of the inner piston assembly 61.

Figure 8:
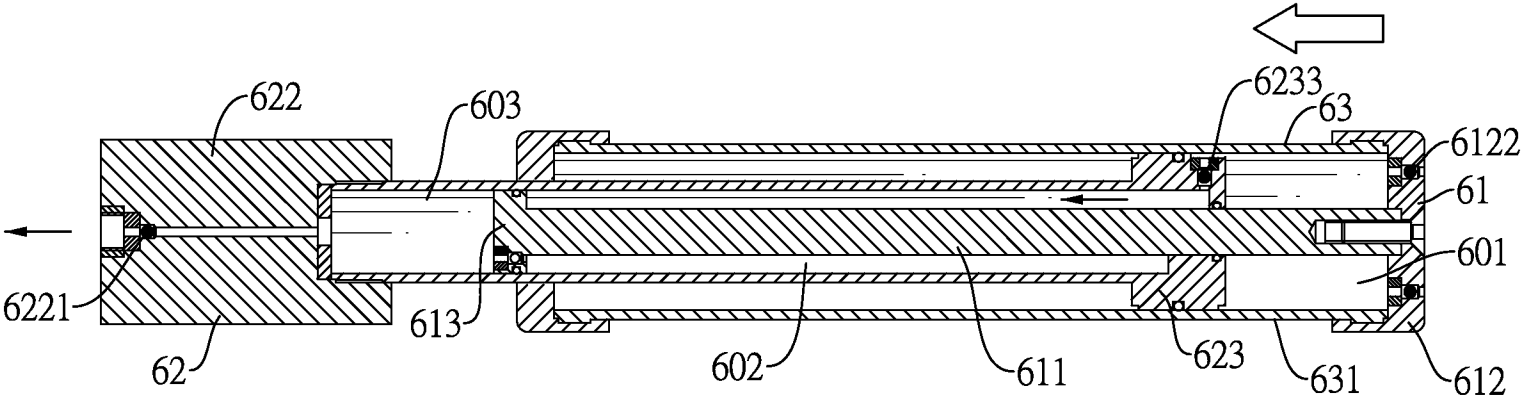
FIG. 8 is another operational side view in partial section of the multistage air pump in FIG. 7.

With further reference to FIG. 8, when the inner piston assembly 61 is pushed, the volume of the second chamber 602 is increased, and the volumes of the first chamber 601 and the third chamber 603 are decreased. Accordingly, the air inside the first chamber 601 and the third chamber 603 is compressed, and the air inside the second chamber 602 is decompressed. Thus, the compressed air inside the first chamber 601 flows into the second chamber 602 via the at least one one-way mechanism 6233 of the surrounding piston assembly 62. The compressed air inside the third chamber 603 flows into the inflatable article via the air channel of the second end cap 622 and the outlet one-way mechanism 6221.

Figure 9:
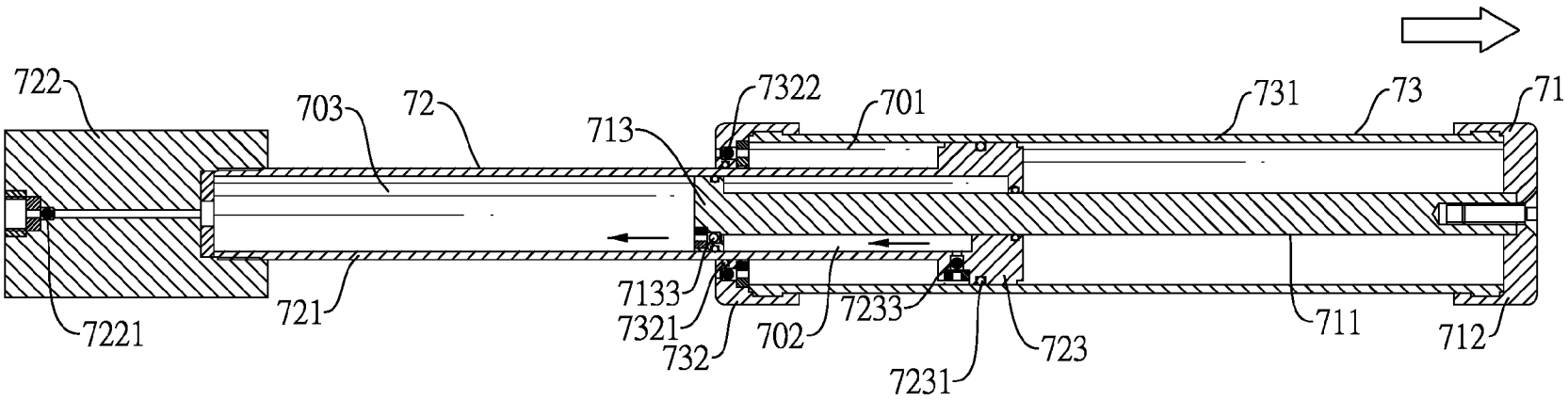
FIG. 9 is an operational side view in partial section of a fifth embodiment of a multistage air pump in accordance with the present invention.

As shown in FIG. 9, in a fifth preferred embodiment, the surrounding piston 723 has an outer sidewall and a proximal end. The proximal end of the surrounding piston 723 is attached to the surrounding rod 721. The second end cap 722 has an air channel. The air channel of the second end cap 722 is axially formed through the second end cap 722 and communicates with the third chamber 703. The surrounding piston assembly 72 has an outer sealing ring 7231 and one outlet one-way mechanism 7221. The outer sealing ring 7231 of the surrounding piston assembly 72 is mounted on and around the outer sidewall of the surrounding piston 723 and abuts the cylinder 731. The outlet one-way mechanism 7221 is mounted in the air channel of the second end cap 722. The at least one one-way mechanism 7233 of the surrounding piston assembly 72 is disposed between the proximal end of the surrounding piston 723 and the outer sealing ring 7231 of the surrounding piston assembly 72.

The multistage air pump has a first chamber 701 defined in the cylinder 731 and between the rear cap 732 and the surrounding piston 723. The at least one one-way mechanism 7233 of the surrounding piston assembly 72 only allows air inside the first chamber 701 to flow into the second chamber 702.

The rear cap 732 has an inner sidewall formed around the through hole of the rear cap 732. The cylinder assembly 73 further has a sealing ring 7321 and at least one inlet one-way mechanism 7322. The sealing ring 7321 of the cylinder assembly 73 is mounted on and around the inner sidewall of the rear cap 732 and abuts the surrounding rod 721. The at least one inlet one-way mechanism 7322 is mounted in the rear cap 732, is disposed around the through hole of the rear cap 732, and only allows air outside the multistage air pump to flow into the first chamber 701.

As shown in FIG. 9, during operation, the second end cap 722 is connected to the inflatable article. The user holds the cylinder assembly 73 and alternately pushes and pulls the cylinder assembly 73 and the inner piston assembly 71 to drive the inner rod 711 and the inner piston 713 to move forwardly and backwardly alternately. When the inner piston assembly 71 is pulled, volumes of the first chamber 701 and the second chamber 702 are decreased, and volume of the third chamber 703 is increased. Accordingly, air inside the first chamber 701 and the second chamber 702 is compressed, and air inside the third chamber 703 is decompressed. Thus, the compressed air inside the second chamber 702 flows into the third chamber 703 via the at least one one-way mechanism 7133 of the inner piston assembly 71. Even though air pressure inside the first chamber 701 is higher than air pressure outside the multistage air pump, the air inside the first chamber 701 does not flow out of the first chamber 701 via the at least one inlet one-way mechanism 7322. The air inside the first chamber 701 does not flow to the second chamber 702 via the at least one one-way mechanism 7233 of the surrounding piston assembly 72 until the air pressure inside the first chamber 701 becomes higher than air pressure inside the second chamber 702.

Figure 10:
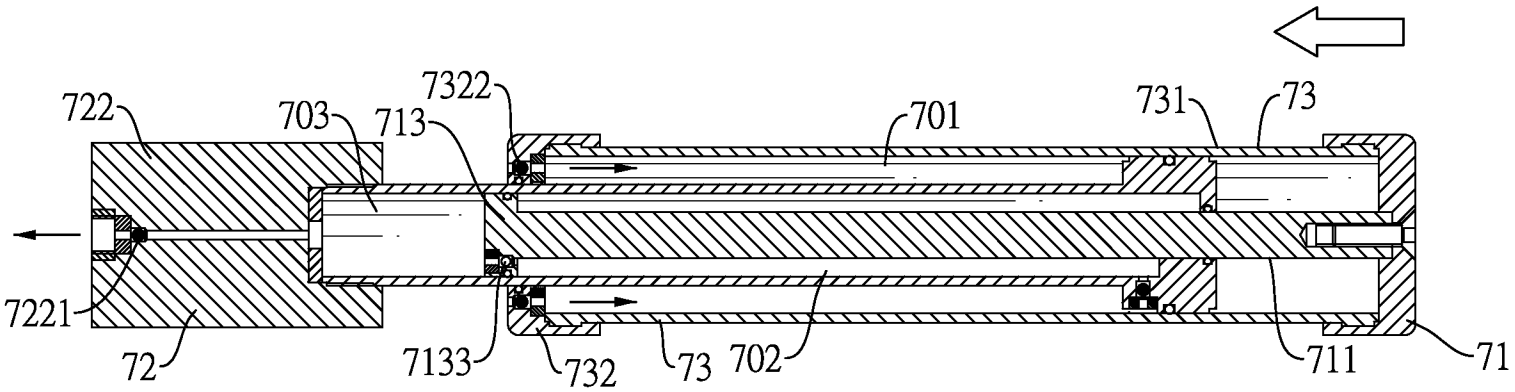
FIG. 10 is another operational side view in partial section of the multistage air pump in FIG. 9.

With further reference to FIG. 10, when the inner piston assembly 71 is pushed, the volume of the third chamber 703 is decreased, and the volumes of the first chamber 701 and the second chamber 702 are increased. Accordingly, the air inside the third chamber 703 is compressed, and the air inside the first chamber 701 and the second chamber 702 is decompressed. Thus, the air outside the multistage air pump flows into the first chamber 701 via the at least one inlet one-way mechanism 7322. The compressed air inside the third chamber 703 cannot flow to the second chamber 702 via the at least one one-way mechanism 7133 of the inner piston assembly 71. The compressed air inside the third chamber 703 flows into the inflatable article via the air channel of the second end cap 722 and the outlet one-way mechanism 7221.

Figure 11:
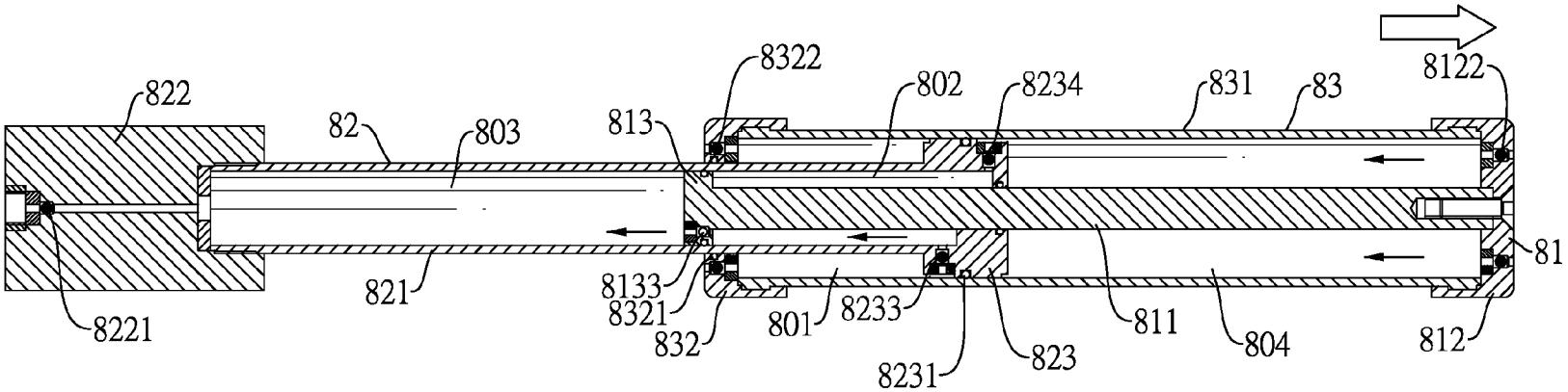
FIG. 11 is an operational side view in partial section of a sixth embodiment of a multistage air pump in accordance with the present invention.

As shown in FIG. 11, in a sixth preferred embodiment, the surrounding piston 823 has an outer sidewall, a distal end, and a proximal end. The proximal end of the surrounding piston 823 is attached to the surrounding rod 821. The second end cap 822 has an air channel. The air channel of the second end cap 822 is axially formed through the second end cap 822 and communicates with the third chamber 803. The surrounding piston assembly 82 further has an outer sealing ring 8231 and one outlet one-way mechanism 8221. The outer sealing ring 8231 of the surrounding piston assembly 82 is mounted on and around the outer sidewall of the surrounding piston 823 and abuts the cylinder 831. The outlet one-way mechanism 8221 is mounted in the air channel of the second end cap 822. The surrounding piston assembly 82 has two one-way mechanisms 8233, 8234. The one-way mechanisms 8233, 8234 of the surrounding piston assembly 82 are respectively disposed between the proximal end of the surrounding piston 823 and the outer sealing ring 8231 of the surrounding piston assembly 82, and between the distal end of the surrounding piston 823 and the outer sealing ring 8231 of the surrounding piston assembly 82.

The multistage air pump has a first chamber 801 and a fourth chamber 804. The first chamber 801 is defined in the cylinder 831 and between the rear cap 832 and the surrounding piston 823. The fourth chamber 804 is defined in the cylinder 831 and between the first end cap 812 and the surrounding piston 823. The one-way mechanisms 8233, 8234 of the surrounding piston assembly 82 only allow air inside the first chamber 801 and the fourth chamber 804 to flow into the second chamber 802.

The cylinder assembly 83 further has at least one inlet one-way mechanism 8322. The at least one inlet one-way mechanism 8322 of the cylinder assembly 83 is mounted in the rear cap 832, is disposed around the through hole of the rear cap 832, and only allows air outside the multistage air pump to flow into the first chamber 801.

The inner piston assembly 81 further has at least one inlet one-way mechanism 8122. The at least one inlet one-way mechanism 8122 of the inner piston assembly 81 is mounted in the first end cap 812, and only allows the air outside the multistage air pump to flow into the fourth chamber 804.

As shown in FIG. 11, during operation, the second end cap 822 is connected to the inflatable article. The user holds the cylinder assembly 83 and alternately pushes and pulls the cylinder assembly 83 and the inner piston assembly 81 to drive the inner rod 811 and the inner piston 813 to move forwardly and backwardly alternately. When the inner piston assembly 81 is pulled, volumes of the first chamber 801 and the second chamber 802 are decreased, and volumes of the third chamber 803 and the fourth chamber 804 are increased. Accordingly, air inside the first chamber 801 and the second chamber 802 is compressed, and air inside the third chamber 803 and the fourth chamber 804 is decompressed. Thus, the compressed air inside the second chamber 802 flows into the third chamber 803 via the at least one one-way mechanism 8133 of the inner piston assembly 81. The compressed air inside the second chamber 802 cannot flow to the first chamber 801 via the one-way mechanism 8233 that is disposed between the proximal end of the surrounding piston 823 and the outer sealing ring 8231 of the surrounding piston assembly 82. The air inside the first chamber 801 cannot flow out of the multistage air pump via the at least one inlet one-way mechanism 8322 of the cylinder assembly 83. As air pressure inside the first chamber 801 is higher than air pressure inside the second chamber 802, the compressed air inside the first chamber 801 flows into the second chamber 802 via the one-way mechanism 8233 that is disposed between the proximal end of the surrounding piston 823 and the outer sealing ring 8231 of the surrounding piston assembly 82. Moreover, the air outside the multistage air pump flows into the fourth chamber 804 via the at least one inlet one-way mechanism 8122 of the inner piston assembly 81. Even though air pressure inside the second chamber 802 is higher than air pressure inside the fourth chamber 804, the air inside the second chamber 802 cannot flow to the fourth chamber 804 via the one-way mechanism 8234 that is disposed between the distal end of the surrounding piston 823 and the outer sealing ring 8231 of the surrounding piston assembly 82.

Figure 12:
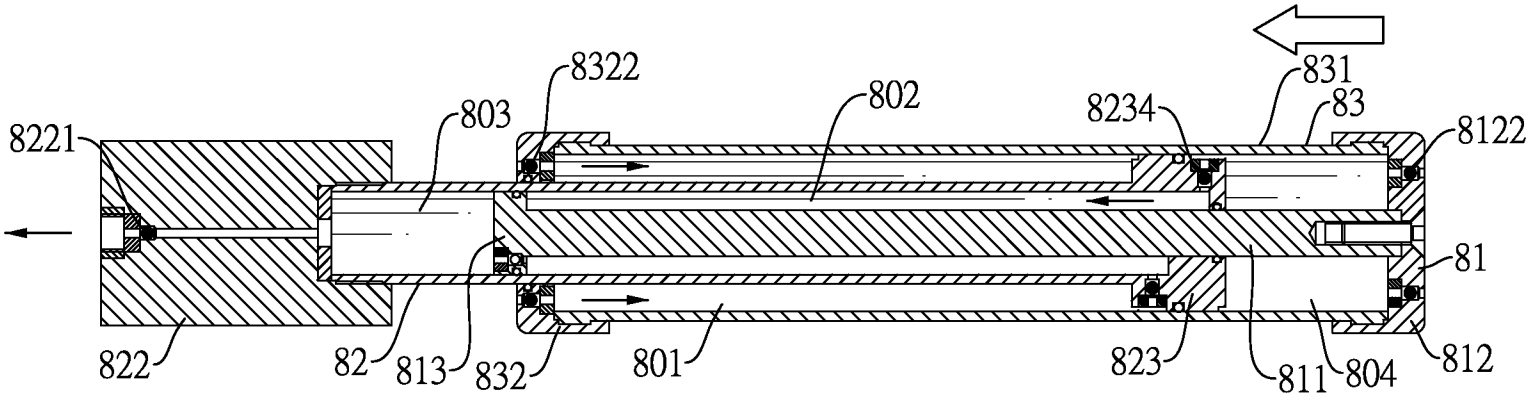
FIG. 12 is another operational side view in partial section of the multistage air pump in FIG. 11.

With further reference to FIG. 12, when the inner piston assembly is pushed, the volumes of the first chamber 801 and the second chamber 802 are increased, and the volumes of the third chamber 803 and the fourth chamber 804 are decreased. Accordingly, the air inside the third chamber 803 and the fourth chamber 804 is compressed, and the air inside the first chamber 801 and the second chamber 802 is decompressed. Thus, the air outside the multistage air pump flows into the first chamber 801 via the at least one inlet one-way mechanism 8322 of the cylinder assembly 83. The compressed air inside the fourth chamber 804 flows into the second chamber 802 via the one-way mechanism 8234 that is disposed between the distal end of the surrounding piston 823 and the outer sealing ring 8231 of the surrounding piston assembly 82. The compressed air inside the fourth chamber 804 cannot flow out of the multistage air pump via the at least one inlet one-way mechanism 8122 of the inner piston assembly 81. Moreover, the compressed air inside the third chamber 803 flows into the inflatable article via the air channel of the second end cap 822 and the outlet one-way mechanism 8221.

Specifically, in the above-mentioned first to sixth preferred embodiments, each of the one-way mechanisms 4132, 4133, 4233, 4121, 4122, 6133, 6233, 6221, 6122, 3322, 5322, 7322, 8322 comprises a mounting hole and a ball. The mounting hole has an outlet end and an inlet end. The outlet end is non-circular in cross-section. The inlet end is opposite to the outlet end, is tapered, and is circular in cross-section. The ball is mounted in the mounting hole and between the outlet end and the inlet end of the mounting hole.

In the second and fourth preferred embodiments, the outlet end of the mounting hole of each of the at least one one-way mechanism 4233, 6233 of the surrounding piston assembly 42, 62 communicates with the second chamber 402, 602, and the tapered inlet end of the mounting hole of each of the at least one one-way mechanism 4233, 6233 of the surrounding piston assembly 42, 62 extends toward and communicates with the first chamber 401, 601. The outlet end of the mounting hole of each of the at least one one-way mechanism 4133, 6133 of the inner piston assembly 41, 61 communicates with the third chamber 403, 603, and the tapered inlet end of the mounting hole of each of the at least one one-way mechanism 4133, 6133 of the inner piston assembly 41, 61 extends toward and communicates with the second chamber 402, 602. The outlet end of the mounting hole of each of the at least one inlet one-way mechanism 4122, 6122 communicates with the first chamber 401, 601, and the tapered inlet end of the mounting hole of each of the at least one inlet one-way mechanism 4122, 6122 extends away from the first chamber 401, 601 and communicates with the exterior of the multistage air pump. The tapered inlet end of the mounting hole of each of the at least one outlet one-way mechanism 4132, 4121, 6221 extends toward and communicates with the third chamber 403, 603.

Specifically, in the second preferred embodiment, the outlet end of the mounting hole of the outlet one-way mechanism 4132 that is mounted in the surrounding piston 413 communicates with the air channel of the inner rod 411, and the tapered inlet end of the mounting hole of the outlet one-way mechanism 4132 that is mounted in the surrounding piston 413 extends toward and communicates with the third chamber 403. The outlet end of the mounting hole of the outlet one-way mechanism 4121 that is mounted in the first cap 412 communicates with the exterior of the multistage air pump, and the tapered inlet end of the mounting hole of the outlet one-way mechanism 4121 that is mounted in the first cap 412 extends toward and communicates with the air channel of the inner rod 411. Thus, the tapered inlet end of the mounting hole of the outlet one-way mechanism 4121 that is mounted in the first cap 412 communicates with the third chamber 403 via the air channel of the inner rod 411.

In the fourth preferred embodiment, the outlet end of the mounting hole of the outlet one-way mechanism 6221 of the surrounding piston assembly 62 communicates with the exterior of the multistage air pump, and the tapered inlet end of the mounting hole of the outlet one-way mechanism 6221 of the surrounding piston assembly 62 extends toward and communicates with the air channel of the second cap 622. Thus, the tapered inlet end of the mounting hole of the outlet one-way mechanism 6221 of the surrounding piston assembly 62 communicates with the third chamber 603 via the air channel of the second cap 622.

In the first, third, fifth, and sixth preferred embodiments, the outlet end of the mounting hole of each of the at least one inlet one-way mechanism 3322, 5322, 7322, 8322 of the cylinder assembly 33, 53, 73, 83 communicates with the first chamber 301, 501, 701, 801, and the tapered inlet end of the mounting hole of each of the at least one inlet one-way mechanism 3322, 5322, 7322, 8322 of the cylinder assembly 33, 53, 73, 83 extends toward and communicates with the exterior of the multistage air pump. The outlet end of the mounting hole of each of the at least one one-way mechanism 3133, 5133, 7133, 8133 of the inner piston assembly 31, 51, 71, 81 communicates with the third chamber 303, 503, 703, 803, and the tapered inlet end of the mounting hole of each of the at least one one-way mechanism 3133, 5133, 7133, 8133 of the inner piston assembly 31, 51, 71, 81 extends toward and communicates with the second chamber 302, 502, 702, 802. The tapered inlet end of the mounting hole of each of the at least one outlet one-way mechanism 3121, 3132, 5121, 5132, 7221, 8221 extends toward and communicates with the third chamber 303, 503, 703, 803. The outlet end of the mounting hole of each of the at least one one-way mechanism 3233, 5233, 5234, 7233, 8233, 8234 of the surrounding piston assembly 32, 52, 72, 82 communicates with the second chamber 302, 502, 702, 802, and the tapered inlet end of the mounting hole of each of the at least one one-way mechanism 3233, 5233, 5234, 7233, 8233, 8234 of the surrounding piston assembly 32, 52, 72, 82 extends toward and communicates with the cylinder 331, 531, 731, 831.

Specifically, the outlet end and the tapered inlet end of the mounting hole of each of the at least one one-way mechanism 3233, 5233, 7233, 8233 that is disposed between the proximal end of the surrounding piston 323, 523, 723, 823 and the outer sealing ring 3231, 5231, 7231, 8231 of the surrounding piston assembly 32, 52, 72, 82 respectively communicate with the second chamber 302, 502, 702, 802 and the first chamber 303, 503, 703, 803.

Furthermore, in the third and sixth preferred embodiments, the outlet end and the tapered inlet end of the mounting hole of each of the at least one one-way mechanism 5234, 8234 that is disposed between the distal end of the surrounding piston 523, 823 and the outer sealing ring 5231, 8231 of the surrounding piston assembly 52, 82 respectively communicate with the second chamber 502, 802 and the first chamber 503, 803. The outlet end of the mounting hole of each of the at least one inlet one-way mechanism 5122, 8122 of the inner piston assembly 51, 81 communicates with the fourth chamber 504, 804, and the tapered inlet end of the mounting hole of each of the at least one inlet one-way mechanism 5122, 8122 of the inner piston assembly 51, 81 extends toward and communicates with the exterior of the multistage air pump.

Specifically, in the first and third preferred embodiments, the outlet end of the mounting hole of the outlet one-way mechanism 3132, 5132 that is mounted in the surrounding piston 313, 513 communicates with the air channel of the inner rod 311, 511, and the tapered inlet end of the mounting hole of the outlet one-way mechanism 3132, 5132 that is mounted in the surrounding piston 313, 513 extends toward and communicates with the third chamber 303, 503. The outlet end of the mounting hole of the outlet one-way mechanism 3121, 5121 that is mounted in the first cap 312, 512 communicates with the exterior of the multistage air pump, and the tapered inlet end of the mounting hole of the outlet one-way mechanism 3121, 5121 that is mounted in the first cap 312, 512 extends toward and communicates with the air channel of the inner rod 311, 511. Thus, the tapered inlet end of the mounting hole of the outlet one-way mechanism 3121, 5121 that is mounted in the first cap 312, 512 communicates with the third chamber 303, 503 via the air channel of the inner rod 311, 511.

Specifically, in the fifth and sixth preferred embodiments, the outlet end of the mounting hole of the outlet one-way mechanism 7221, 8221 of the surrounding piston assembly 72, 82 communicates with the exterior of the multistage air pump, and the tapered inlet end of the mounting hole of the outlet one-way mechanism 7221, 8221 of the surrounding piston assembly 72, 82 extends toward and communicates with the air channel of the second cap 722, 822. Thus, the tapered inlet end of the mounting hole of the outlet one-way mechanism 7221, 8221 of the surrounding piston assembly 72, 82 communicates with the third chamber 703, 803 via the air channel of the second cap 722, 822.

Figure 13:
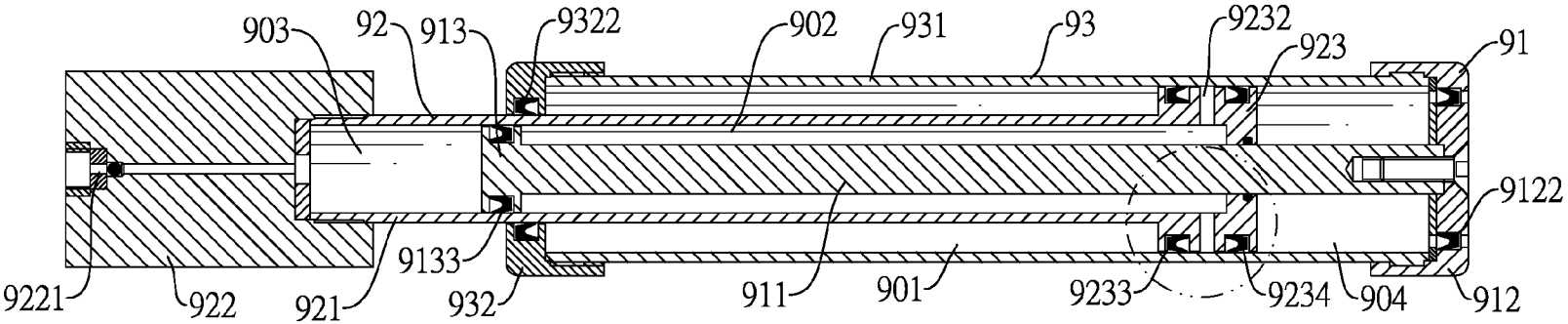
FIG. 13 is an operational side view in partial section of a seventh embodiment of a multistage air pump in accordance with the present invention.
Figure 14:
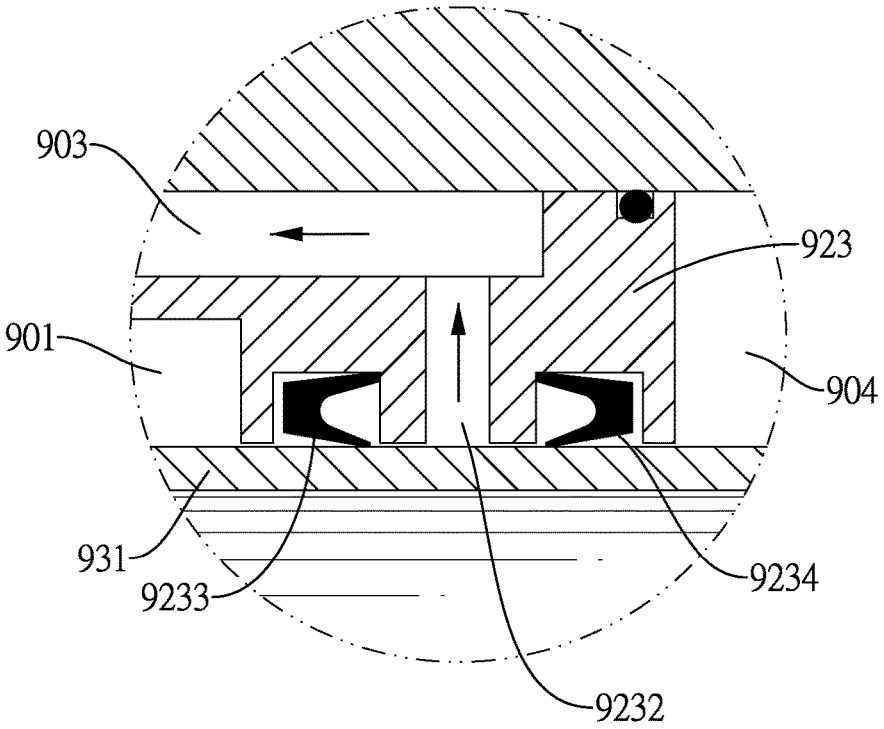
FIG. 14 is another operational side view in partial section of the multistage air pump in FIG. 13.
Figure 15:
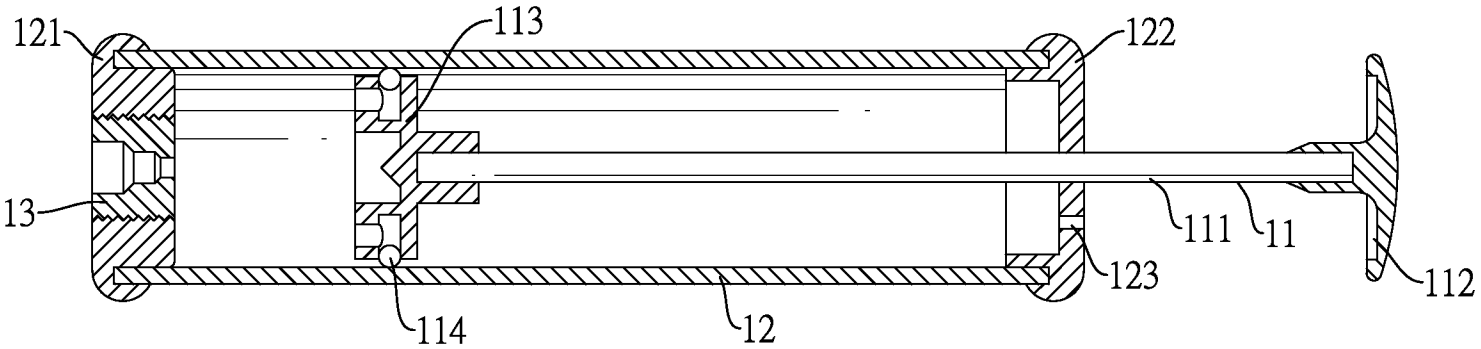
FIG.15 PRIOR ART
FIG. 15 is a side view in partial section of a conventional air pump in accordance with the prior art.
Figure 16:
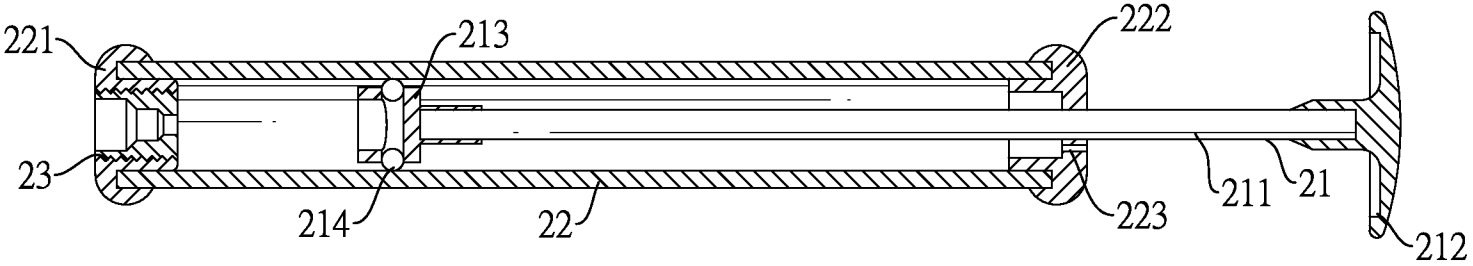
FIG.16 PRIOR ART
FIG. 16 is a side view in partial section of another conventional air pump in accordance with the prior art.

As shown in FIG. 13, in a seventh preferred embodiment, the surrounding piston 923 has an outer sidewall, a distal end, a proximal end, and at least one ventilation hole 9232. The proximal end of the surrounding piston 923 is attached to the surrounding rod 921. The at least one ventilation hole 9232 is radially formed through the surrounding piston 923.

The second end cap 922 has an air channel. The air channel of the second end cap 922 is axially formed through the second end cap 922 and communicates with the third chamber 903. The surrounding piston assembly 92 further has one outlet one-way mechanism 9221. The outlet one-way mechanism 9221 is mounted in the air channel of the second end cap 922.

The surrounding piston assembly 92 has two one-way mechanisms 9233, 9234. The one-way mechanisms 9233, 9234 of the surrounding piston assembly 92 are respectively disposed between the proximal end of the surrounding piston 923 and the at least one ventilation hole 9232, and between the distal end of the surrounding piston 923 and the at least one ventilation hole 9232.

The multistage air pump has a first chamber 901 and a fourth chamber 904. The first chamber 901 is defined in the cylinder 931 and between the rear cap 932 and the surrounding piston 923. The fourth chamber 904 is defined in the cylinder 931 and between the first end cap 912 and the surrounding piston 923. The one-way mechanisms 9233, 9234 of the surrounding piston assembly 92 only allow air inside the first chamber 901 and the fourth chamber 904 to flow into the second chamber 902.

The cylinder assembly 93 further has at least one inlet one-way mechanism 9322. The at least one inlet one-way mechanism 9322 of the cylinder assembly 93 is mounted in the rear cap 932, is disposed around the through hole of the rear cap 932, and only allows air outside the multistage air pump to flow into the first chamber 901.

The inner piston assembly 91 further has at least one inlet one-way mechanism 9122. The at least one inlet one-way mechanism 9122 of the inner piston assembly 91 is mounted in the first end cap 912, and only allows the air outside the multistage air pump to flow into the fourth chamber 904.

Specifically, the outlet one-way mechanism 9221 of the surrounding piston assembly 92 comprises a mounting hole and a ball. The mounting hole has an outlet end and an inlet end. The outlet end is non-circular in cross-section. The inlet end is opposite to the outlet end, is tapered, and is circular in cross-section. The outlet end of the mounting hole of the outlet one-way mechanism 9221 of the surrounding piston assembly 92 communicates with the exterior of the multistage air pump, and the tapered inlet end of the mounting hole of the outlet one-way mechanism 9221 of the surrounding piston assembly 92 extends toward and communicates with the air channel of the second cap 922. The ball is mounted in the mounting hole and between the outlet end and the inlet end of the mounting hole.

Each of the rest of the one-way mechanisms 9133, 9233, 9234, 9322, 9122 of the inner piston assembly 91, the surrounding piston assembly 92, and the cylinder assembly 93 comprises an annular channel and a V-ring. The V-ring is mounted in the annular channel and has an operating end surface, an annular groove, and two resilient tabs. The annular groove is formed in and around the operating end surface of the V-ring. The resilient tabs are oppositely formed beside the annular groove.

The annular channel of the at least one one-way mechanism 9133 of the inner piston assembly 91 is formed in and around an outer sidewall of the inner piston 913. The annular groove of the V-ring of the at least one one-way mechanism 9133 of the inner piston assembly 91 faces the third chamber 903. The resilient tabs of the V-ring of the at least one one-way mechanism 9133 of the inner piston assembly 91 respectively abut the inner piston 913 and the surrounding rod 921.

The annular channels of the one-way mechanisms 9233, 9234 of the surrounding piston assembly 92 are separately formed in and around the outer sidewall of the surrounding piston 923. The annular grooves of the V-rings of the one-way mechanisms 9233, 9234 of the surrounding piston assembly 92 face the at least one ventilation hole 9232 of the surrounding piston 923. The resilient tabs of each of the V-rings of the one-way mechanisms 9233, 9234 of the surrounding piston assembly 92 respectively abut the surrounding piston 923 and the cylinder 931.

The annular channel of the inlet one-way mechanism 9322 of the cylinder assembly 93 is formed in and around an inner sidewall of the rear cap 932. The annular groove of the V-ring of the inlet one-way mechanism 9322 of the cylinder assembly 93 faces the first chamber 901. The resilient tabs of the V-ring of the inlet one-way mechanism 9322 of the cylinder assembly 93 respectively abut the rear cap 932 and the surrounding rod 921.

The annular channel of the inlet one-way mechanism 9122 of the inner piston assembly 91 is axially formed through the first end cap 912. The annular groove of the V-ring of the inlet one-way mechanism 9122 of the inner piston assembly 91 faces the fourth chamber 901. The resilient tabs of the V-ring of the inlet one-way mechanism 9122 of the inner piston assembly 91 abut the first end cap 912.

As shown in FIG. 13, during operation, changes in air pressure of the first chamber 901, 801, the second chamber 902, 802, the third chamber 903, 803, and the fourth chamber 904, 804 of the seventh and sixth preferred embodiments of the multistage air pump are substantially the same.

When the air pressure of the first chamber 901 is higher than the air pressure of the third chamber 903 and the air pressure of the fourth chamber 904, air inside the first chamber 901 passes between the surrounding piston 923 and the cylinder 931 and pushes the resilient tab of the V-ring of the one-way mechanism 9233 that is disposed between the proximal end of the surrounding piston 923 and the at least one ventilation hole 9232 to flow into the second chamber 902 via the at least one ventilation hole 9232. Moreover, the air from the first chamber 901 fills the annular groove of the V-ring of the one-way mechanism 9233 that is disposed between the distal end of the surrounding piston 923 and the at least one ventilation hole 9232 to prevent the V-ring from shrinking. Thus, the resilient tab of the V-ring of the one-way mechanism 9233 that is disposed between the distal end of the surrounding piston 923 and the at least one ventilation hole 9232 securely abuts the cylinder 931, and the air from the first chamber 901 does not flow to the fourth chamber 904.

Likewise, when the air pressure inside the first chamber 901 is lower than the air pressure outside the multistage air pump, air outside the multistage air pump pushes the tab of the V-ring of the inlet one-way mechanism 9322 of the cylinder assembly 93 to flow into the first chamber 901. When the air pressure inside the first chamber 901 is higher than the air pressure outside the multistage air pump, the air inside the first chamber 901 does not flow out of the multistage air pump via the V-ring of the inlet one-way mechanism 9322 of the cylinder assembly 93. Descriptions about air flows between the fourth chamber 904 and the exterior of the multistage air pump, between the fourth chamber 904 and the second chamber 902, and between the third chamber 903 and an inflatable article are omitted.

The multistage air pump as described has the following advantages. Air drawn into the multistage air pump is compressed and pressurized in multiple stages within a single push by the piston assemblies 31, 41, 51, 61, 71, 81, 91, 32, 42, 52, 62, 72, 82, 92. Thus, the multistage air pump can provide a large amount of high pressure air. Accordingly, inflating the article with the multistage air pump is labor-saving and efficient.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multistage air pump comprising:

a cylinder assembly having a cylinder having a front end and a rear end;

a rear cap mounted on the rear end of the cylinder and having a through hole; and an inner sidewall formed around the through hole of the rear cap;

a sealing ring mounted on and around the inner sidewall of the rear cap; and at least one inlet one-way mechanism mounted in the rear cap and disposed around the through hole of the rear cap;

a surrounding piston assembly slidably mounted through the through hole of the rear cap and having a surrounding rod slidably mounted through the through hole of the rear cap, abutting the sealing ring of the cylinder assembly, and having an inner end protruding in the cylinder;

an outer end protruding out of the cylinder; and a sliding channel axially formed between the inner end of the surrounding rod and the outer end of the surrounding rod;

a surrounding piston formed on the inner end of the surrounding rod and having a through hole axially formed through the surrounding piston and communicating with the sliding channel of the surrounding rod;

an inner sidewall formed around the through hole of the surrounding piston;

an outer sidewall;

a distal end; and a proximal end attached to the surrounding rod;

a second end cap mounted on the outer end of the surrounding rod and having an air channel axially formed through the second end cap and coaxial with a longitudinal axis of the surrounding rod;

an inner sealing ring mounted on and around the inner sidewall of the surrounding piston; and an outer sealing ring mounted on and around the outer sidewall of the surrounding piston and abutting the cylinder; and an outlet one-way mechanism mounted in the air channel of the second end cap;

two one-way mechanisms respectively disposed between the proximal end of the surrounding piston and the outer sealing ring of the surrounding piston assembly, and between the distal end of the surrounding piston and the outer sealing ring of the surrounding piston assembly;

an inner piston assembly mounted on the cylinder and having an inner rod axially mounted in the cylinder, mounted through the through hole of the surrounding piston, and abutting the inner sealing ring of the surrounding piston assembly, and the inner rod having an inner end protruding in the sliding channel of the surrounding rod; and an outer end;

an inner piston formed on the inner end of the inner rod;

a first end cap mounted on the front end of the cylinder and connected to the outer end of the inner rod;

at least one one-way mechanism mounted in the inner piston;

at least one inlet one-way mechanism mounted in the first end cap;

a first chamber defined in the cylinder and between the rear cap and the surrounding piston;

a second chamber defined in the sliding channel of the surrounding rod and between the surrounding piston and the inner piston;

a third chamber defined in the sliding channel of the surrounding rod and between the surrounding piston and the second end cap;

a fourth chamber defined in the cylinder and between the first end cap and the surrounding piston;

wherein the air channel of the second end cap directly communicates with the third chamber and communicates with an exterior of the multistage air pump via the outlet one-way mechanism of the surrounding piston assembly;

wherein the at least one inlet one-way mechanism that is mounted in the rear cap only allows air outside the multistage air pump to flow into an interior of the cylinder;

the outlet one-way mechanism of the surrounding piston assembly only allows air inside the third chamber to flow to the exterior of the multistage air pump;

the at least one one-way mechanism of the inner piston assembly only allows air inside the second chamber to flow into the third chamber;

the one-way mechanism that is disposed between the proximal end of the surrounding piston and the outer sealing ring of the surrounding piston assembly only allows air inside the first chamber to flow into the second chamber;

the one-way mechanism that is disposed between the distal end of the surrounding piston and the outer sealing ring of the surrounding piston assembly only allows air inside the fourth chamber to flow into the second chamber; and the at least one inlet one-way mechanism of the inner piston assembly only allows the air outside the multistage air pump to flow into the fourth chamber;

wherein when the inner piston assembly is pulled, the air inside the first chamber is compressed and flows into the second chamber, the air inside the second chamber is compressed and flows into the third chamber, and the air outside the multistage air pump flows into the fourth chamber;

when the inner piston assembly is pushed, the air outside the multistage air pump flows into the first chamber, the air inside the fourth chamber is compressed and flows into the second chamber, and the air inside the third chamber is compressed and flows out of the multistage air pump via the outlet one-way mechanism of the surrounding piston assembly for inflation.

2. The multistage air pump as claimed in claim 1, wherein each of the at least one inlet one-way mechanism that is mounted in the rear cap comprises a mounting hole having an outlet end being non-circular in cross-section; and an inlet end being tapered and being circular in cross-section; and a ball mounted in the mounting hole and between the outlet end and the inlet end of the mounting hole;

the tapered inlet end of the mounting hole of each of the at least one inlet one-way mechanism that is mounted in the rear cap extends toward and communicates with the exterior of the multistage air pump.

3. The multistage air pump as claimed in claim 2, wherein each of the one-way mechanisms of the surrounding piston assembly and the inner piston assembly comprising a mounting hole having an outlet end being non-circular in cross-section; and an inlet end being tapered and being circular in cross-section; and a ball mounted in the mounting hole and between the outlet end and the inlet end of the mounting hole;

the outlet one-way mechanism of the surrounding piston assembly comprising a mounting hole having an outlet end being non-circular in cross-section; and an inlet end being tapered and being circular in cross-section;

a ball mounted in the mounting hole and between the outlet end and the inlet end of the mounting hole;

the tapered inlet end of the mounting hole of each of the at least one one-way mechanism of the inner piston assembly extends toward and communicates with the second chamber;

the tapered inlet end of the mounting hole of each of the at least one outlet one-way mechanism extends toward and communicates with the third chamber; and the tapered inlet end of the mounting hole of each of the at least one one-way mechanism of the surrounding piston assembly extends toward and communicates with the cylinder.

* * * * *